US006536693B2

(12) United States Patent
Van Mullem et al.

(10) Patent No.: US 6,536,693 B2
(45) Date of Patent: Mar. 25, 2003

(54) ROCK CRUSHER SEAL

(75) Inventors: Albert J. Van Mullem, Sussex, WI (US); Bernard R. McCready, Brown Deer, WI (US); Mark R. Zawlocki, Menomonee Falls, WI (US)

(73) Assignee: Sandvik AB, Sandviken (SE)

( * ) Notice: Subject to any disclaimer, the term of this patent is extended or adjusted under 35 U.S.C. 154(b) by 8 days.

(21) Appl. No.: 09/755,694

(22) Filed: Jan. 5, 2001

(65) Prior Publication Data

US 2002/0088885 A1 Jul. 11, 2002

(51) Int. Cl.[7] ..... B02C 2/06
(52) U.S. Cl. ..... 241/209; 241/216
(58) Field of Search ..... 241/207–216

(56) References Cited

U.S. PATENT DOCUMENTS

| | | | | |
|---|---|---|---|---|
| 3,633,316 A | * | 1/1972 | Belser | 16/225 |
| 3,924,815 A | | 12/1975 | Haggren | |
| 4,179,076 A | | 12/1979 | Barrot et al. | |
| 4,384,684 A | | 5/1983 | Karra | |
| 4,410,143 A | | 10/1983 | Polinski | |
| 4,467,971 A | | 8/1984 | Schuman | |
| 4,478,373 A | | 10/1984 | Gieschen | |
| 4,519,551 A | | 5/1985 | Ceurvorst | |
| 4,659,026 A | | 4/1987 | Krause et al. | |
| 4,750,679 A | | 6/1988 | Karra et al. | |
| 4,919,348 A | * | 4/1990 | Johnson et al. | 241/215 |
| 5,022,593 A | | 6/1991 | Stelk | |
| 5,031,843 A | | 7/1991 | Motz | |
| 5,080,294 A | | 1/1992 | Dean | |
| 5,372,318 A | | 12/1994 | Jacobson | |
| 5,769,340 A | | 6/1998 | Jean | |
| 5,775,607 A | * | 7/1998 | Bayliss et al. | 241/207 |
| 5,803,382 A | | 9/1998 | Ganser, IV et al. | |
| 5,810,269 A | | 9/1998 | Shannon | |
| 5,915,638 A | | 6/1999 | Jean | |
| 5,934,583 A | | 8/1999 | Jean | |
| 5,938,133 A | | 8/1999 | Bayliss et al. | |
| 5,944,265 A | | 8/1999 | Ganser, IV et al. | |
| 5,964,422 A | | 10/1999 | Ruokonen et al. | |
| 5,996,916 A | | 12/1999 | Musil | |
| 6,007,009 A | | 12/1999 | Sheridan et al. | |

* cited by examiner

*Primary Examiner*—Mark Rosenbaum
(74) *Attorney, Agent, or Firm*—Burns, Doane, Swecker & Mathis, LLP

(57) ABSTRACT

A socket seal for a gyratory crusher is comprised of a ring with a pair of lips extending therefrom. The ring can have an outwardly expanding dovetail which is inserted into a slot in the piston or hemispherical bearing socket. The seal prevents downward flow of oil from the lubricated space between the hemispherical bearing ball and socket.

30 Claims, 2 Drawing Sheets

ROCK CRUSHER SEAL

FIELD OF THE INVENTION

The present invention relates to rock crushing systems, such as conical rock crushers or gyratory crushers. More specifically, the present invention relates to a bearing lubrication system socket seal for rock crushers.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle.

A spider assembly rests on the top shell, forming the top of the support structure for the machine. The spider assembly is designed to support the shaft while allowing gyratory movement during operation of the machine.

A shaft extends vertically through the rock crusher. This shaft is supported by a bearing in the spider assembly. The central portion of the shaft tapers inwardly in an upward direction to form the central conical crushing member. The central portion of the shaft supports the mantle, which moves with the shaft to effect the gyratory crushing operation.

The vertical position of the shaft with respect to the spider assembly is controlled by a piston arrangement in the spider assembly. The piston arrangement is a complex mechanical apparatus including a piston, a bearing, and an attachment system. The piston is slidably disposed within the spider assembly. The bearing is supported by the piston and supports the shaft while allowing gyratory motion. The bearing has a hemispherical ball disposed in a socket; the hemispherical ball is lubricated by a lubricant such as oil. The attachment system is required to clamp the ball to the shaft.

A lubricant is pumped into a space between ball and socket of the bearing. The lubricant exits through a drain at the top of the spider. A seal, known as a socket seal, below the bearing prevents the lubricant from leaking downward into the crushing chamber. The seal is disposed between the shaft and the piston.

The conventional designs for the seal have several drawbacks. First, the conventional designs do not offer any redundancy in the event a part of the seal fails. Second, conventional seals require additional hardware. Third, conventional seals tend to lose integrity due to the gyratory motion of the shaft. Thus, the performance of conventional seals can be increased.

Therefore, it would be advantageous to have a socket seal that has built-in redundancy. Further, there is a need for a socket seal that may be installed by hand. Further still, there is a need for a socket seal that does not lose contact with either the shaft or piston while the crusher is operating.

SUMMARY OF THE INVENTION

An exemplary embodiment relates to a gyratory crusher. The gyratory crusher has a shell, a spider supported by the shell, a piston disposed within the spider, a bearing supported by the piston, and a shaft supported by the bearing. The gyratory crusher has an annular seal extending between the piston and the shaft. The seal has a number of lips.

Another embodiment relates to a socket seal for a gyratory crusher. The gyratory crusher has a shaft supported by a bearing disposed within a piston. The socket seal includes a ring having a first edge and a second edge. The seal has at least two lips extending from the first edge of the ring. The seal is disposed between the shaft and the piston. The seal is coupled to both the shaft and the piston during operation of the gyratory crusher.

A further embodiment relates to a method of installing an annular seal in a gyratory crusher. The gyratory crusher includes a shell, a spider supported by the shell, and a piston disposed within the spider. The crusher also includes a bearing having a ball and a socket supported by the piston, a shaft supported by the bearing, and a seal space. The seal space is defined by the socket, piston, and shaft. The method includes the steps of providing the annular seal and removing the bearing. Access is gained to the seal space by removing the bearing. The method then includes installing the seal in the seal space.

A still further embodiment relates to a gyratory crusher including a shell, a spider, a piston, a bearing, a shaft, and an annular seal. The spider is supported by the shell and the piston is disposed within the spider. The bearing is supported by the piston and has a ball and socket defining a lubricated interface. The shaft is supported by the bearing. The annular seal has a plurality of lips. The seal is disposed below the lubricated interface. The seal prevents downward flow of lubricant.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
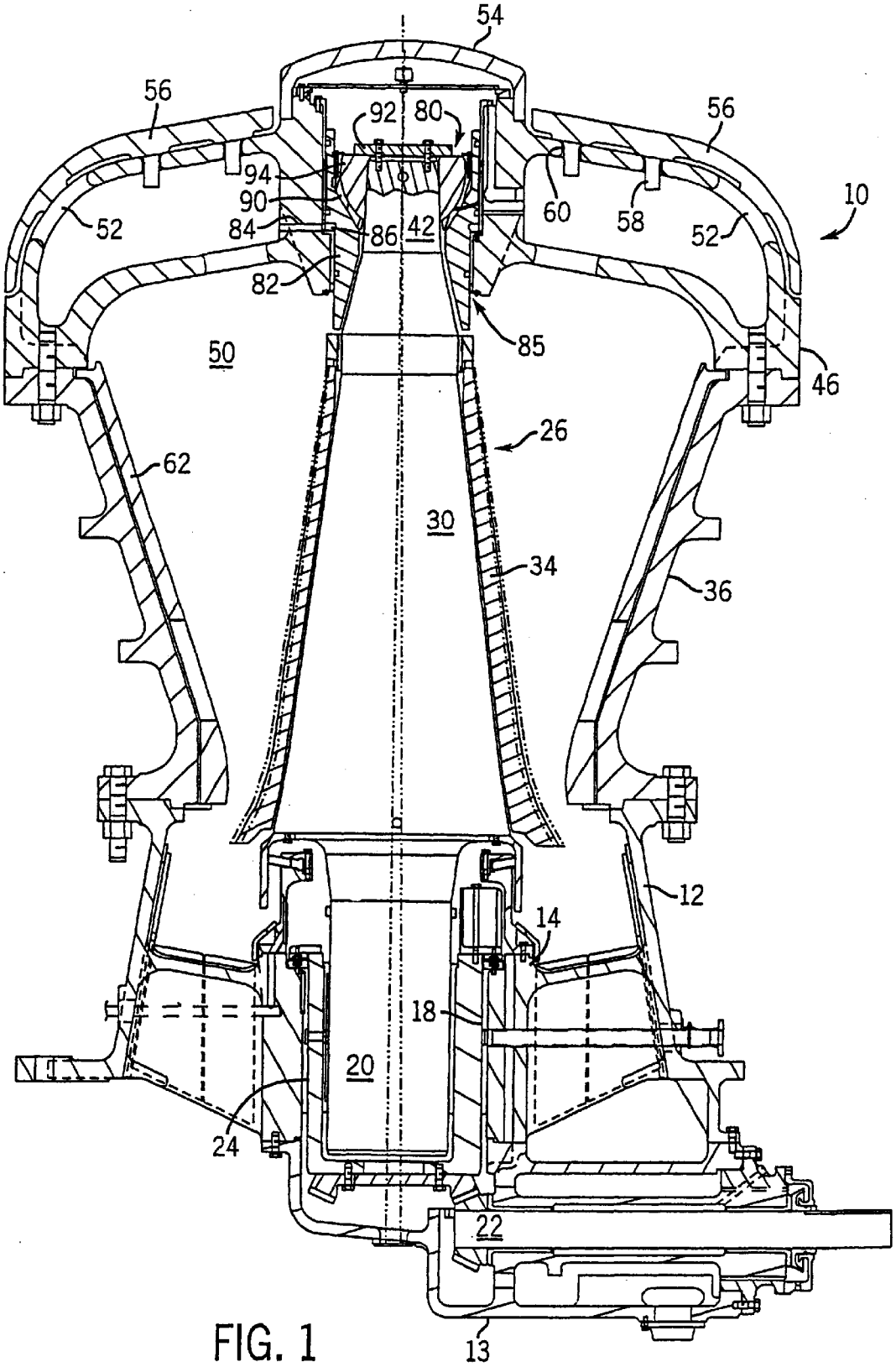
FIG. 1 is a vertical cross-sectional view of a gyratory crusher.

Referring to FIG. 1, a gyratory crusher 10 can be utilized to crush rock, ore, minerals, waste, or other material. Gyratory crusher 10 is assembled on a cast steel base or bottom shell 12 having a central hub 14. Central hub 14 is provided with a vertical bore 18 adapted to receive a cylindrical support shaft 20 and eccentric 24. Shaft 20 varies in cross section, but extends through the machine into the spider 46. Drive housing 13 extends outwardly from hub 14 to enclose a drive mechanism 22. Drive mechanism 22 causes rotation of the eccentric 24 which directs the gyratory motion of the shaft 20.

A head assembly 26, which is part of the shaft 20, includes a head member 30 which is covered by a mantle 34. Mantle 34 provides one of the crushing surfaces of crusher 10.

A top shell 36 projects upwardly from bottom shell 12 and is covered by a spider assembly including a spider 46. Alternatively, top shell 36 and bottom shell 12 can be a single piece component. Spider 46 receives an end 42 of shaft 20.

Top shell 36 is protected from wear by several rows of concaves 62. Concaves 62 provide the crushing surface opposing mantle 34. Spider 46 can be attached or rest upon top shell 36. Vertical positioning of shaft 20 with respect to top shell 36 adjusts the relative position of concaves 62 with respect to the mantle 34 of the head member 30, thereby adjusting the size of the crushed material exiting crusher 10.

Material to be crushed is supplied through spider 46 which includes openings for entry of the material into crushing cavity 50. A liquid flush apparatus (not shown) may be provided for spraying a liquid such as water toward the crusher cavity 50.

Spider 46 is comprised of spider arms 52 radially extending outward from the center to a spider rim (not shown). A spider cap 54 sits on the top center of the spider 46. Each of the spider arms 52 is protected from falling material by a spider arm guard 56. The rim of spider 46 is protected by a rim liner, also known as a hopper liner.

Shaft 20 is supported by a bearing 80 within spider 46. The bearing 80 has a ball 94 disposed within a socket 90. The bearing 80 is disposed within a piston 82 that travels vertically within spider 46 to adjust the vertical positioning of shaft 20. Piston 82 is slidably disposed within an aperture 85 of spider 46. Piston 82 is moved by a hydraulic system. The hydraulic system includes a hydraulic fluid inlet 84, and a hydraulic fluid ring 86 that is filled to move piston 82 vertically. A bearing retainer plate 92 is used to secure shaft 20 to ball 94.

Figure 2:
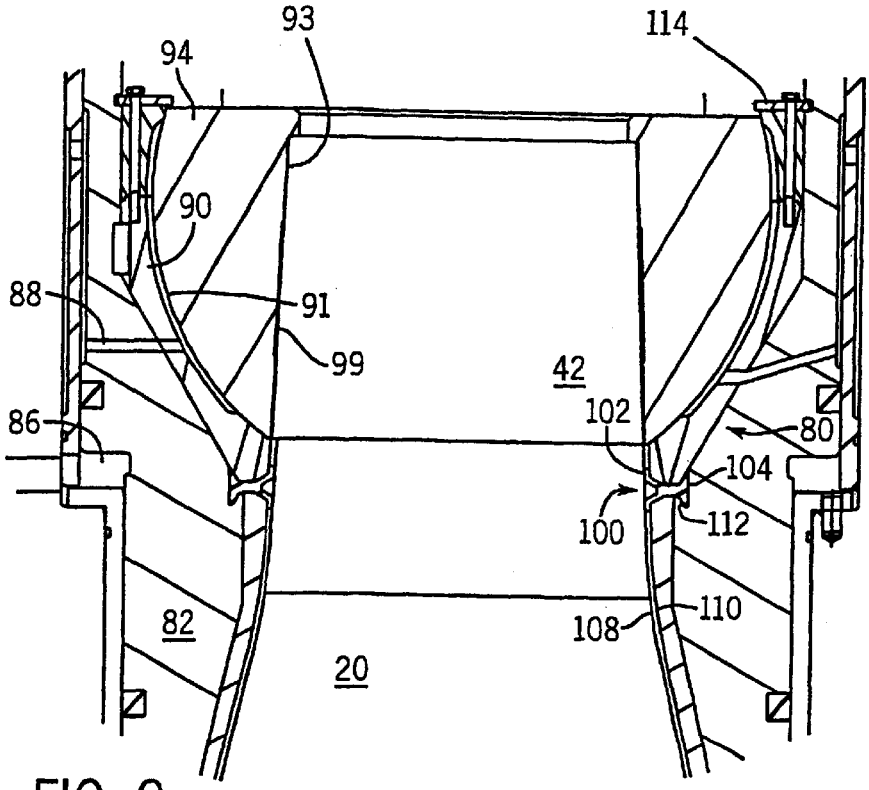
FIG. 2 is a more detailed cross-sectional view of a bearing and socket seal of a gyratory crusher.

Referring to FIG. 2, socket retaining plates or ring 114 is bolted onto socket 90. Ball 94 has a hemispherical structure designed to receive top end 42 of shaft 20. Ball 94 includes aperture 93 for receiving end 42. Aperture 93 is tapered in accordance with the taper associated with end 42. Aperture 93 includes a groove 99. Groove 99 serves to aid in the removal of ball 94 from shaft 20 when the groove 99 is pressurized. In a preferred embodiment, the ball 94 has a radius of about 13.4 inches and is lubricated by oil within grooves 91 of socket 90.

Shaft 20 is disposed in and supported by bearing 80. The bearing is lubricated by oil that is input through the lubricating oil inlet 88. The oil travels throughout the bearing and exits through a drain hole at the top of the spider 46. A seal is required to prevent oil from traveling downward out of the bearing 80 and into the crusher chamber 50.

A socket seal 100 prevents leakage of lubricants such as oil into crusher chamber 50. The seal 100 maintains contact with shaft 20 while crusher 10 is operating. In the area of the seal 100, the shaft 20 may move plus or minus 0.25 inches in a horizontal direction during gyration. The range of this movement is indicated by lines 108 and 110 in FIG. 2. Additionally, the shaft 20 will rotate during crusher operation, so seal 100 must maintain contact with shaft 20 during rotational motion as well. In some crusher embodiments, the shaft 20 will move vertically with respect to the seal 100 as well.

Seal 100 is preferably stationary with respect to piston 82 and does not rotate in this embodiment. Rotation is prevented by slightly compressing seal 100 between socket 90 and piston 82. The seal 100 must perform under a wide range of lubrication flows. This is because greater power crushers 10 require a higher bearing 80 lubricating oil flow than crushers 10 with lower power requirements. Lubrication oil flow rates can range from two to twenty gallons per minute.

Figure 3:
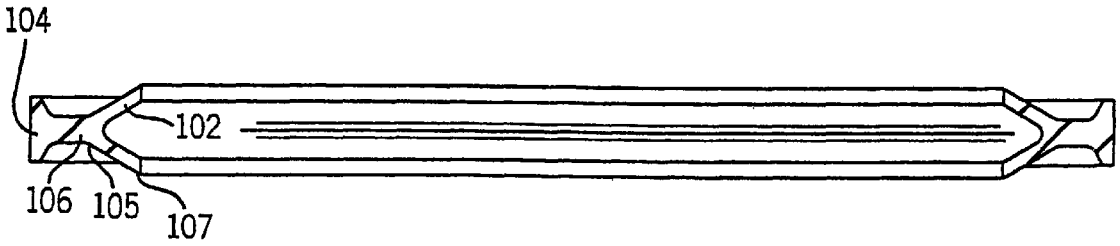
FIG. 3 is a cross-sectional view of the socket seal.

Referring to FIG. 3, socket seal 100 has two lips 102 extending from middle span 106. Accordingly, seal 100 has a Y shape. Seal 100 also includes dovetail 104 that expands outwardly from middle span 106. According to an alternative embodiment, seal 100 can include three or more lips similar to lips 102. According to a still further embodiment, seal 100 could have a single lip 102.

In a preferred embodiment, socket seal 100 has an inner diameter of 15.8 inches and an outer diameter of 19.8 inches. Lips 102 extend 1.6 inches from an outside bend 105 to an end 107, and the angle between the two lips 102 is approximately 60 degrees. The middle span 106 has an inner diameter of 17.9 inches and an outer diameter of 19.0 inches. The middle span 106 is about 0.5 inches in height. The dovetail 104 has an inner diameter of 19.0 inches and an outer diameter of 19.8 inches. The dovetail is 1.2 inches in height at the outer diameter.

In alternative embodiments, the socket seal 100 dimensions may be changed to accommodate shaft and piston arrangements of differing sizes.

In a preferred embodiment, shaft 20 has an outer diameter of about 16.4 inches in the region where contact is made between lips 102 and shaft 20. Because seal 100 has an inner diameter of 15.8 inches, and the range of gyratory axial motion is only plus or minus 0.25 inches, the lips 102 each maintain contact with the shaft 20 while the crusher 10 is operating.

In a preferred embodiment socket seal 100 is made of polyurethane, which may be impregnated with molybdenum disulfide. Alternative materials for seal 100 are rubber, Nitrite rubber, nylon, Viton, Teflon, or any flexible compound. The dovetail 104 is inserted into a slot or an aperture 112 in piston 82, with the lips 102 extending inwardly making contact with shaft 20. The flexible polyurethane material allows the lips 102 to maintain contact with shaft 20 over its full range of motion. The aperture is sized to retain dovetail 104.

In an alternative embodiment a slot can be provided in shaft 20. With such an embodiment, dovetail 104 is disposed in the slot on shaft 20 and lips 102 contact piston 82 or other fixed portion of crusher 10. In a still further embodiment, seal 100 could be clamped on to shaft 20.

The new socket seal arrangement has several advantages over conventional seals. First, the lips 102 provide redundancy for the sealing function. This is particularly important where a conventional wiper seal will not function adequately. The redundant lips 102 are able to seal in oil while excluding dust and contaminants from the bearing 80. Second, the socket seal is reversible because it is symmetrical. Therefore, if there is uneven wear, the seal 100 can be reversed to give extra longevity, reducing operational costs. Third, the seal 100 requires no hardware for installation. Rather, it may be installed by hand by inserting the dovetail 104 into slot or aperture 112 in piston 82. Conventional seals can require bolts or clamping to install the seal. Fourth, because of the lip design that includes a greater amount of overlap with shaft 20, the seal 100 is able to withstand gyratory motion while maintaining contact with shaft 20 where conventional seals would lose contact with the shaft due to the large off-center movement of gyratory crushing operation. The length of lips 102 not only helps maintain contact between seal 100 and shaft 20, but the long lips 102 reduce the stress on the seal material, spreading the lip deflection over a long span.

The socket seal 100 is installed as follows. The bearing 80 is removed through the top of the spider 46 by first decoupling the bearing retainer plate 92 from the shaft 20. This will result in the shaft 20 not being clamped to the ball 94. After removing the socket retaining ring 114, the ball 94 and socket 90 can then be lifted out separately through the top of the spider assembly 46. Because the aperture 112 is partially defined by socket 90, the removal of socket 90 allows the removal of socket seal 100 from the retaining slot 112 in a direction parallel to the center axis of the shaft 20.

A new seal 100 is installed by hand by placing the dovetail 104 into the vacant aperture 112 and then reinstalling the socket 90 and ball 94 into the recessed in the spider 46. The shaft 20 may then be reclamped to bearing 80 through the use of retaining plate 92.

The gyratory crusher 10 operates as follows. When the drive mechanism 22 is driven by any appropriate means, mechanism 22 transmits power to the eccentric 24. Eccentric 24 causes the gyration of the head assembly 26, resulting in the crushing of the material in the crushing chamber 50. The phantom lines flanking the mantle 34 and shaft 20 axis on FIG. 1 indicate the range of gyratory motion.

The above arrangement solves the longstanding problems discussed in the Background of the Invention section because the socket seal 100 does not lose contact with the shaft 20 during gyratory motion. Additionally, the socket seal 100 has a measure of redundancy with the two lips 102. Further still, the socket seal 100 requires no hardware to be installed on the crusher 10. Further, the socket seal 100 has a longer life span because it may be reversed.

While several embodiments of the invention have been described, it should be apparent to those skilled in the art that what has been described is considered at present to be the preferred embodiments of a spider piston socket seal. However, in accordance with the patent statutes, changes may be made in the design without actually departing from the true spirit and scope of this invention. The following claims are intended to cover all such changes and modifications which fall within the true spirit and scope of this invention.

What is claimed is:

1. A gyratory crusher, comprising:

a shell;

a spider supported by the shell;

a piston disposed within the spider;

a bearing assembly supported by the piston;

a shaft coupled to the bearing; and an annular seal extending between the piston and the shaft, the seal having a plurality of lips.

2. The gyratory crusher of claim 1, wherein the seal is made of polyurethane.

3. The gyratory crusher of claim 2, wherein the seal is impregnated with molybdenum disulfide.

4. The gyratory crusher of claim 1, wherein the seal is symmetrical about a horizontal plane.

5. The gyratory crusher of claim 1, further comprising:

an outwardly expanding portion, extending from the seal in a direction opposite to the lips, wherein the outwardly expanding portion is retained in a slot in the piston.

6. The gyratory crusher of claim 5, wherein the outwardly expanding portion is retained between the slot and a portion of the bearing assembly.

7. The gyratory crusher of claim 6, wherein the lips are separated by an angle of 60 degrees.

8. The gyratory crusher of claim 5 wherein the slot is arranged to enable the seal to be installed therein or removed therefrom in a direction substantially parallel to a center axis of the shaft.

9. The gyratory crusher of claim 1, further comprising:

an outwardly expanding portion, extending from the seal in a direction opposite to the lips, wherein the outwardly expanding portion is retained in a slot in the shaft.

10. The gyratory crusher of claim 1, wherein the seal has at least two lips.

11. The gyratory crusher of claim 1, wherein the seal has an inner diameter of about 16 inches and an outer diameter of about 20 inches.

12. The gyratory crusher of claim 1, wherein the bearing assembly includes a hemispherical bearing.

13. A socket seal in combination with a gyratory crusher having a shaft supported by a bearing disposed within a piston, the seal comprising:

a ring with a first edge and a second edge; and a plurality of lips extending from the first edge of the ring, the seal disposed between the shaft and the piston, whereby the seal contacts both the shaft and the piston during operation of the gyratory crusher.

14. The combination of claim 13, wherein the seal is made of polyurethane.

15. The combination of claim 14, wherein the seal is impregnated with molybdenum disulfide.

16. The combination of claim 13, wherein the seal is symmetrical about a horizontal axis.

17. The combination of claim 13, further comprising:

an outwardly expanding portion, extending from the second edge, wherein the outwardly expanding portion is retained in a slot in the piston.

18. The combination of claim 17 wherein the slot is arranged to enable the seal to be installed therein or removed therefrom in a direction substantially parallel to a center axis of the shaft.

19. The combination of claim 13, further comprising:

an outwardly expanding portion, extending from the second edge, wherein the outwardly expanding portion is retained in a slot in the shaft.

20. The combination of claim 13, wherein the seal has two lips.

21. The combination of claim 13, wherein the seal has three lips.

22. The combination of claim 13, wherein the seal has an inner diameter of about 16 inches and an outer diameter of about 20 inches.

23. The combination of claim 20, wherein the lips are separated by an angle of 60 degrees.

24. The combination of claim 13, wherein the bearing is a hemispherical bearing.

25. A gyratory crusher, comprising:

a shell;

a spider supported by the shell;

a piston disposed within the spider;

a bearing supported by the piston, the bearing having a ball and a socket defining a lubricated interface;

a shaft supported by the bearing; and a seal means for preventing lubricant from exiting the lubricated interface, the seal means having a plurality of lips disposed below the lubricated interface.

26. The gyratory crusher of claim 25, wherein the seal means is made of polyurethane.

27. The gyratory crusher of claim 26, wherein the seal means is impregnated with molybdenum disulfide.

28. The gyratory crusher of claim 25, wherein the seal means may be installed by hand.

29. The gyratory crusher of claim 25, wherein the seal means is symmetrical about a horizontal axis.

30. The gyratory crusher of claim 25, further comprising:

an outwardly expanding portion, extending from the seal in a direction opposite to the lips, wherein the outwardly expanding portion is retained in a slot in the piston.

* * * * *